US006152806A

United States Patent [19]

Nystrom

[11] Patent Number: 6,152,806

[45] Date of Patent: Nov. 28, 2000

[54] CONCENTRIC PLATENS

[75] Inventor: James C. Nystrom, Palo Alto, Calif.

[73] Assignee: Applied Materials, Inc., Santa Clara, Calif.

[21] Appl. No.: 09/211,997

[22] Filed: Dec. 14, 1998

[51] Int. Cl.[7] ..... B24B 1/00; B24B 29/00

[52] U.S. Cl. ..... 451/36; 451/57; 451/65; 451/287; 451/288; 451/527; 451/529; 451/550

[58] Field of Search ..... 451/28, 36, 41, 451/50, 59, 57, 60, 63, 65, 283, 285, 286, 287, 288, 289, 290, 526, 527, 529, 548, 550

[56] References Cited

U.S. PATENT DOCUMENTS

| | | | |
|---|---|---|---|
| 3,841,031 | 10/1974 | Walsh . | |
| 5,658,185 | 8/1997 | Morgan, III et al. | 451/36 |
| 5,951,380 | 9/1999 | Kim | 451/65 |
| 5,972,162 | 10/1999 | Cesna | 156/345 |
| 5,975,991 | 11/1999 | Karlsrud | 451/41 |
| 6,015,337 | 1/2000 | Hiyama et al. | 451/288 |

*Primary Examiner*—Timothy V. Eley
*Attorney, Agent, or Firm*—Fish & Richardson

[57] ABSTRACT

A chemical mechanical polishing apparatus includes a plurality of concentric rotatable platens for polishing a substrate. A polishing pad is attached to each platen. Each platen may be rotated independently in either clockwise or counterclockwise direction.

18 Claims, 10 Drawing Sheets

CONCENTRIC PLATENS

BACKGROUND

The present invention relates generally to chemical mechanical polishing of substrates, and more particularly to the construction of a polishing platen of a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the exposed surface of the substrate becomes increasingly non-planar. This non-planar surface presents problems in the photolithographic steps of the integrated circuit fabrication process. Therefore, there is a need to periodically planarize the substrate surface to provide a flat surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be a "standard" pad in which the polishing pad surface is a durable roughened surface, or a fixed-abrasive pad in which abrasive particles are held in a containment media. The carrier head provides a controllable load, i.e., pressure, on the substrate to push it against the polishing pad. A polishing slurry, including at least one chemically-reactive agent, and abrasive particles if a standard pad is used, is supplied to the polishing pad to provide an abrasive chemical solution at the interface between the pad and the substrate.

One problem encountered in the CMP process is non-uniform polishing along the radii of the substrate as a result of various factors. Such factors include the carrier head construction, uneven pressure exerted on the substrate, and non-uniform polishing surfaces. One example of non-uniform polishing is the so-called "edge-effect", the tendency for the edge of the substrate to be polished at a slightly different rate than the center of the substrate. The non-uniform polishing of the substrate reduces the overall flatness of the substrate and makes the over-polished or under-polished regions of the substrate unsuitable for use in integrated circuits, decreasing the yield.

Another problem encountered in the CMP process is difficulty in removing the substrate from the polishing pad. As mentioned, a layer of slurry is supplied to the surface of the polishing pad. When the substrate is placed in contact with the polishing pad, the surface tension of the slurry generates an adhesive force which binds the substrate to the polishing pad. The adhesive force may make it difficult to remove the substrate from the pad.

Typically, the substrate is vacuum-chucked to the underside of the carrier head, and the carrier head is used to remove the substrate from the polishing pad. When the carrier head is retracted from the polishing pad, the substrate is lifted off the pad. However, if the vacuum-chucking force is not substantially greater than the surface tension holding the substrate on the polishing pad, then the substrate may fracture or chip if the surface tension causes the substrate to drop from the carrier head. In addition, failure to remove the substrate can cause a machine fault requiring manual intervention. This requires shutting down the polishing apparatus, decreasing throughput. To achieve reliable operation from the polishing apparatus, the substrate removal process should be essentially flawless.

In view of the foregoing, there is a need for a CMP apparatus which provides a greater control in polishing the substrate and which reduces the adhesive force between the substrate and the polishing pad for a flawless substrate removal process.

SUMMARY

In one aspect, the invention is directed to a chemical mechanical polishing apparatus. The apparatus comprises a first rotatable platen including a first top surface and a second rotatable platen including a second top surface. The second platen surrounds the first platen. Both platens rotate about a main central axis.

Implementations of the invention may include the following. The first platen has an outer perimeter, and the second platen has an inner perimeter. The diameter of the outer perimeter of the first platen is less than diameter of the inner perimeter of the second platen. The perimeters are separated by a boundary gap. The first and second platens may rotate in opposite directions. The first and second platens may independently rotate in either a clockwise or counter-clockwise direction. The apparatus may include a first polishing pad having a first polishing surface provided on the first top surface of the first platen, and a second polishing pad having a second polishing surface provided on the second top surface of the second platen. The apparatus may include a slurry reservoir below the platens for storing and introducing the slurry onto the polishing surfaces. The platens may include a spiral passage provided in interior of at least one of the platens and extending down to the slurry reservoir to assist an upward flow of the slurry stored in the reservoir onto the polishing surfaces. The apparatus may include at least one nozzle placed within the boundary gap and extending down to the slurry reservoir to introduce slurry from the slurry reservoir onto the polishing surfaces. The apparatus may include a circular channel provided below the boundary gap for collecting slurry expelled from the polishing surfaces. The apparatus includes a carrier head positioned above the polishing surfaces, the carrier head for receiving and holding a substrate and placing a face of the substrate in sliding engagement with at least one of the polishing surfaces. The carrier head may oscillate laterally over the polishing surfaces in a predetermined path.

In another aspect, the invention is directed to a chemical mechanical polishing apparatus including a plurality of polishing stations. At least one of the polishing station has a plurality of concentric platens rotatable about a central axis.

In another aspect, the invention is directed to a method of polishing a substrate. In the method, a first polishing pad having a first surface is rotated about a main central axis. A second polishing pad having a second polishing surface is rotated about the main central axis. A face of the substrate is placed in a sliding engagement with at least one of the polishing surfaces. The polishing pads may be rotated simultaneously. The polishing pads may be rotated at different speeds. The polishing pads may be rotated in opposite directions. The substrate is placed in sliding engagement with at least one of the polishing surfaces by a carrier head. The carrier head may rotate about its axis. The carrier head may oscillate laterally in a predetermined path over the polishing surfaces.

Advantages of the invention may include one or more of the following. The CMP apparatus provides a user with a greater varability over the control parameters used in polishing a substrate. These control parameters include the size of the inner platen, the size of the outer platen, the rotational direction and speed of the inner platen, the rotational direction and speed of the outer platen, the positioning of the carrier head, and the lateral oscillatory motion of the carrier head. These control parameters may be used to counter non-uniform polishing along the radii of a substrate and polish the substrate at faster rate. In addition, rotating the inner and outer platens in opposite directions reduces the adhesive force between the substrate and the polishing pads provided on the platens since the inner and outer platens exert opposing forces on the substrate.

Other features and advantages of the invention will be apparent from the description which follows, including the drawings and claims.

DETAILED DESCRIPTION

Figure 1:
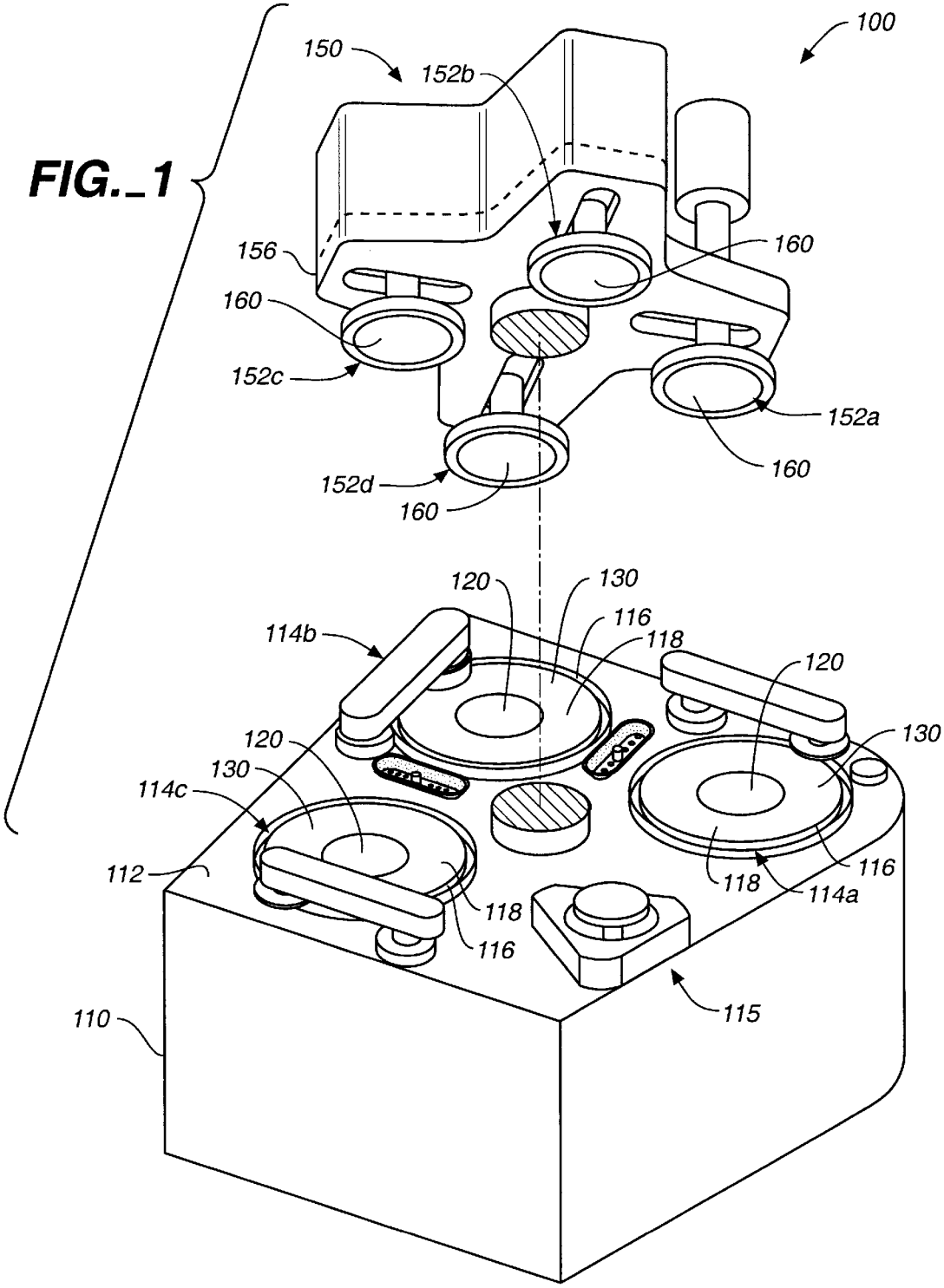
FIG. 1 is a schematic exploded perspective view of a CMP apparatus.

Referring to FIG. 1, one or more substrates may be polished by a CMP apparatus 100. A description of CMP apparatus 100 may be found in U.S. Pat. No. 5,738,574, the entire disclosure of which is incorporated herein by reference. The CMP apparatus 100 includes a lower machine base 110 with a table top 112 mounted thereon and a removable outer cover (not shown). Table top 112 supports a series of polishing stations 114*a,* 114*b* and 114*c,* and a transfer station 115. The transfer station 115 forms a generally square arrangement with the three polishing stations 114*a,* 114*b* and 114*c.* The transfer station 115 serves multiple functions, including receiving individual substrates from a loading apparatus (not shown), washing the substrates, loading the substrates into carrier heads, receiving the substrates from the carrier heads, washing the substrates again, and finally, transferring the substrates back to the loading apparatus.

Each polishing station 114*a*–114*c* includes a rotatable platen assembly 116 on which is placed a polishing pad assembly 118. If a substrate is an eight inch (200 millimeter) diameter disk, then the platen assembly 116 and pad assembly 118 will be about twenty inches in diameter. For most polishing processes, the platen drive motor rotates the platen assembly 116 at thirty to two hundred revolutions per minute, although lower or higher rotational speeds may be used.

A rotatable multi-head carousel 150 is positioned above the lower machine base 110. The carousel 150 includes four carrier head systems 152*a,* 152*b,* 152*c* and 152*d.* Three of the carrier head systems receive and hold substrates, and polish them by pressing them against the polishing pads on the platens of the polishing stations 114*a*–114*c.* One of the carrier head systems receives a substrate from and delivers a substrate to the transfer station 115.

Each carrier head system 152*a*–152*d* includes a polishing or carrier head 160. Each carrier head 160 independently rotates about its own axis, and independently oscillates laterally in a predetermined path.

Figure 2:
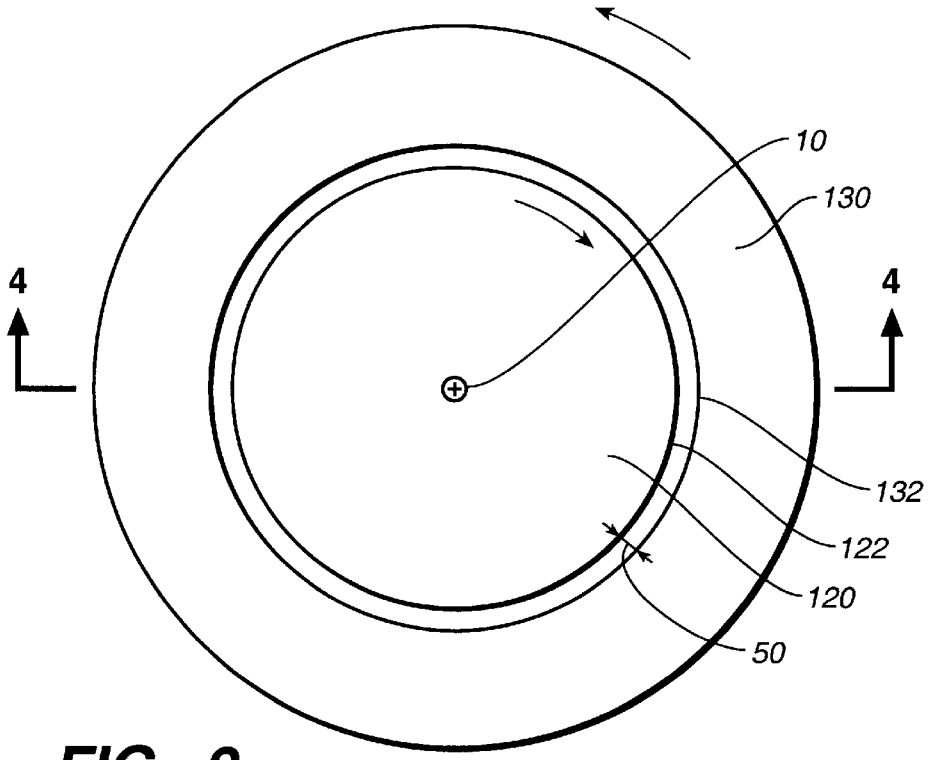
FIG. 2 is a schematic top view of a polishing station in accordance with the present invention.
Figure 3:
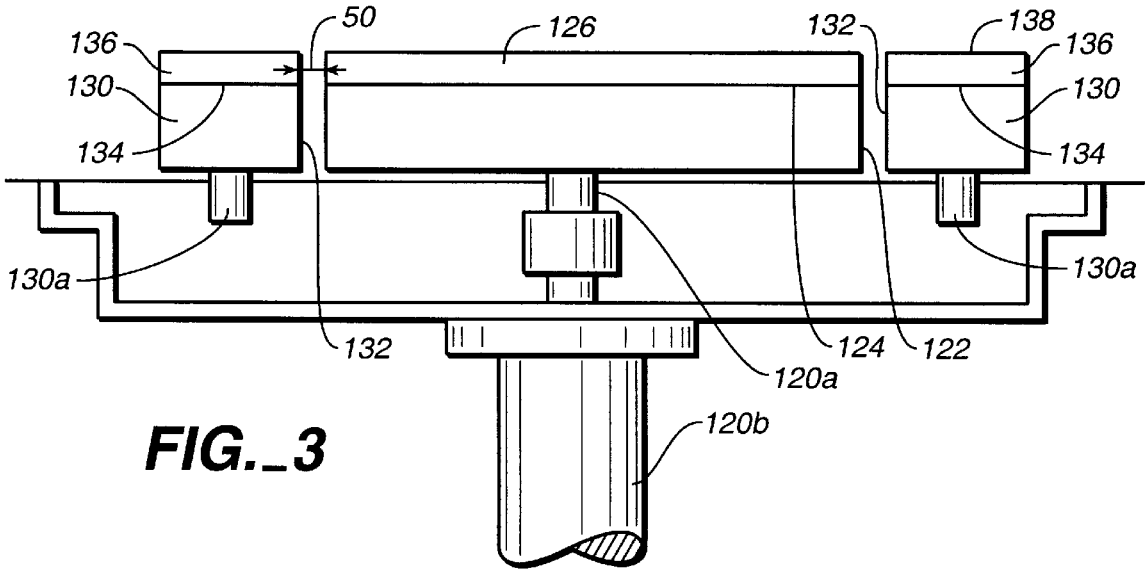
FIG. 3 is a cross-sectional view of FIG. 2 showing driving mechanisms of inner and outer platens.

A close-up, top view of a polishing station, e.g., the polishing station 114*a,* is shown in FIG. 2. The platen assembly 116 includes a pair of concentric platens, including an inner platen 120 and an outer platen 130, which are positioned concentrically and which are rotatable about a main central axis 10. The two platens may be rotated in the same direction or in opposite directions. The inner platen 120 may be driven via a shaft 120*a* by a first motor 120*b* (FIG. 3). The outer platen 130 may be driven by an annular pulley 130*a* by a second motor (not shown) (FIG. 3).

An outer perimeter 122 of the inner platen 120 has diameter less than that of an inner perimeter 132 of the outer platen 130. The perimeters are separated by a boundary gap 50. In one embodiment, the inner platen 120 has diameter of 14 inches; the outer platen 130 has diameter of 22 inches; and the boundary gap 50 has width of 0.05 inch.

Figure 4:
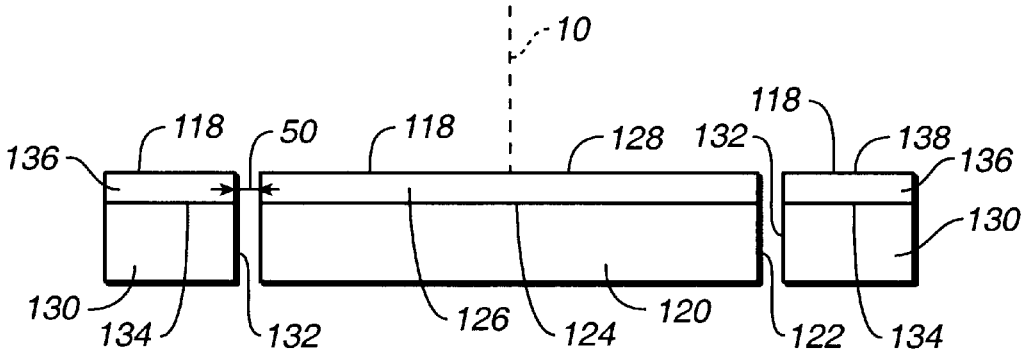
FIGS. 4 is a cross-sectional view taken along line 4—4 of the polishing station of FIG. 2, showing only the platens and polishing pads.

A cross-sectional view of FIG. 2 taken along line 4—4 is shown in FIG. 4. The polishing pad assembly 118 includes a first polishing pad 126 with a first polishing surface 128 and a second polishing pad 136 with a second polishing surface 138. The first polishing pad 126 is attached to a first top surface 124 of the inner platen 120, whereas the second polishing pad 136 is attached to a second top surface 134 of the outer platen 130.

Each polishing pad may be a two-layer pad with a hard upper layer and a soft lower layer. The upper layer may be composed of polyurethan mixed with fillers. The lower layer may be composed of felt fibers mixed with urethane. However, the first and the second polishing pad may have different polishing properties as required by a user.

Like the platens, the polishing pads are concentric and rotatable about the main central axis 10. The polishing pads, attached to the platens, mirror the rotational motion of the respective platens. If the platens rotate in the same direction, the polishing pad rotate in the same direction. If the platens rotate in the opposite directions, the polishing pads rotate in the opposite directions.

Figure 5:
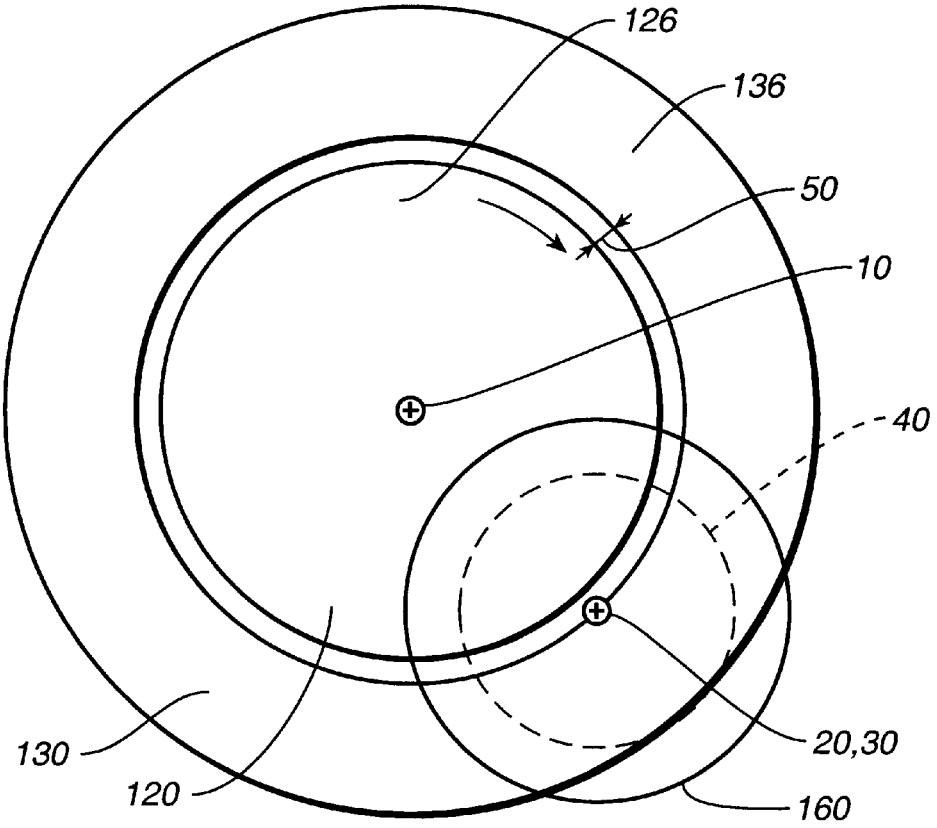
FIG. 5 is a schematic top view of the polishing station of FIG. 2 with a carrier head positioned above the polishing station.

FIG. 5 shows the carrier head 160 positioned above one of the polishing station. The carrier head 160 is positioned above the first and second polishing surfaces 126 and 136 of the polishing pads. The carrier head 160 receives and holds a substrate 40 and places a face of the substrate 40 in a sliding engagement with at least one of the polishing surfaces to polish the substrate 40.

A net downward force is applied to the substrate 40 so as to slightly compress the polishing pad. The force applied may be used as one factor to achieve a desired polishing rate in addition to other factors such as the substrate material, pad material and thickness, rotational speeds, and type of polishing slurry used.

Typically, a slurry containing a reactive agent (e.g., deionized water for oxide polishing) and a chemically reactive catalyzer (e.g., potassium hydroxide for oxide polishing) is supplied to the polishing surface. Sufficient slurry is provided to cover and wet the entire polishing surface. The slurry may include abrasive particles (e.g., colloidal silicon oxide).

The carrier head 160 may be connected to a carrier head motor (not shown) to enable the carrier head 160 to rotate about its carrier head axis 20 during the polishing procedure. The substrate 40, held by the carrier head 160, may have its substrate axis 30 aligned to the carrier head axis 20 and mirror the rotational motion of the carrier head 160, rotating about the carrier head axis 20. Alternatively, the substrate 40 may not have its axis 30 aligned to the carrier head axis 20 (not shown). The carrier head 160 and substrate 40 still rotate about the carrier head axis 20, wherein the substrate axis 30 makes an orbit about the carrier head axis 20.

The carrier head 160 and substrate 40 may be rotated in clockwise or counter-clockwise direction. They may rotate in the same direction to that of either the inner platen 120 or outer platen 130. Alternatively, they may rotate in the opposite direction of either the inner platen 120 or outer platen 130. The carrier head 160 may rotated at the same speed, or at faster or slower speed to either platen.

In one embodiment, the carrier head 160 and substrate 40 may rotate about the carrier axis 20 using frictional force between the polishing surfaces and substrate 40, rather than driving the carrier head drive. Some of the factors that influence the rotational speed are the rotational speeds of the polishing surfaces, the size and geometry of the substrate 40, the size and geometry of the polishing surfaces, the downward pressure exerted on the polishing surfaces, and the position of the substrate 40 on the polishing surfaces at a given time. A brake (not shown) for resisting rotation of substrate 40 may be provided to increase the frictional interaction between the substrate 40 and the polishing surfaces.

Figure 6:
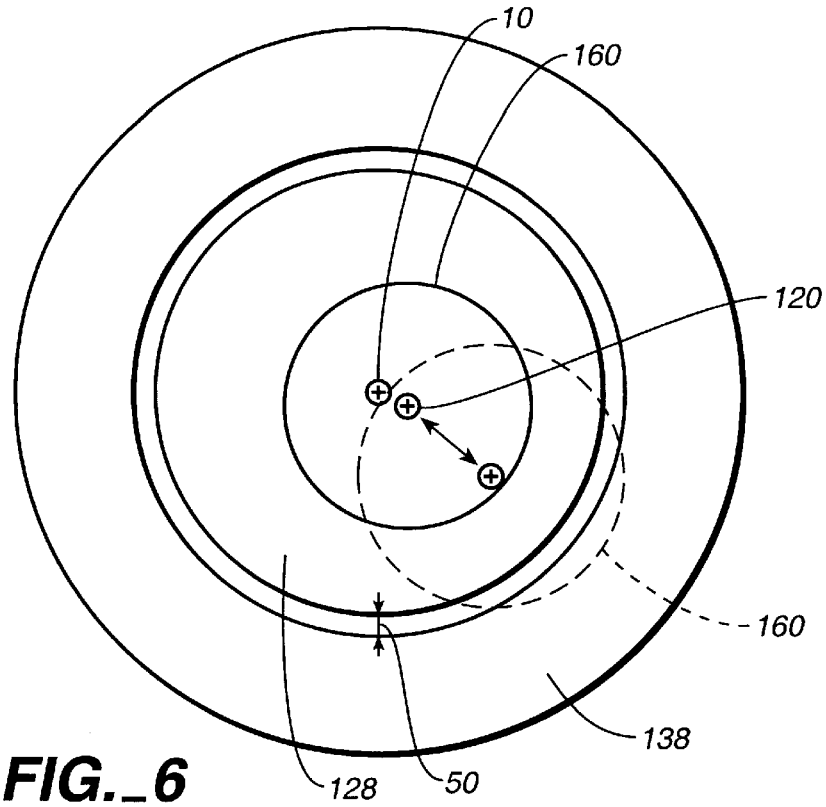
FIGS. 6–8 illustrate oscillating movements of the carrier head over the polishing station during the polishing process.
Figure 7:
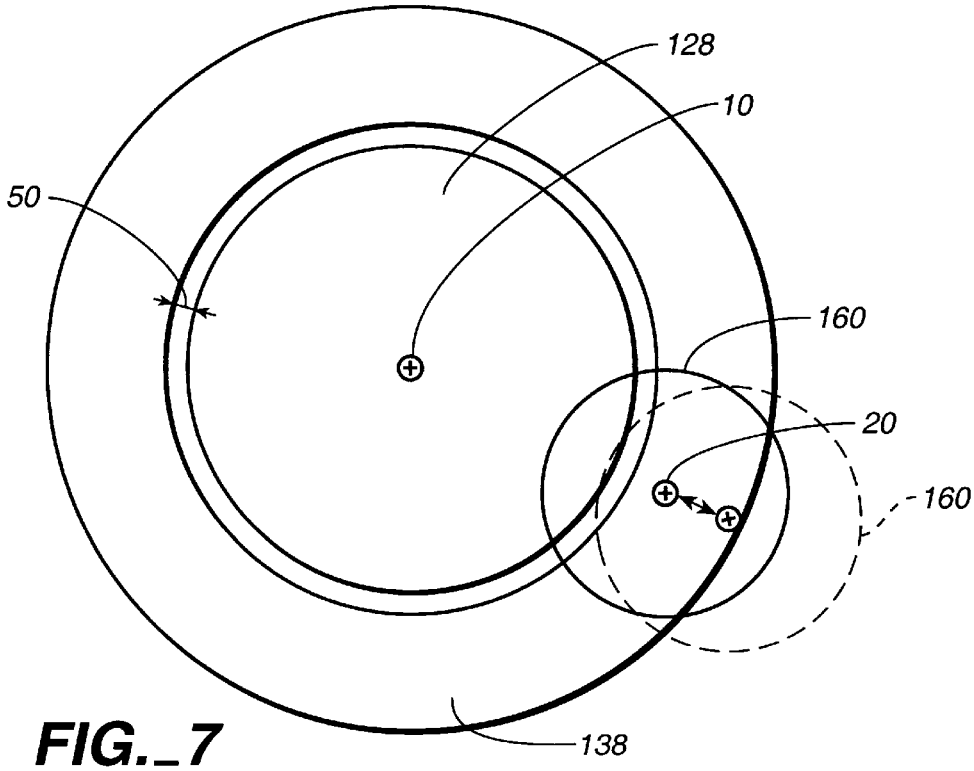
Figure 8:
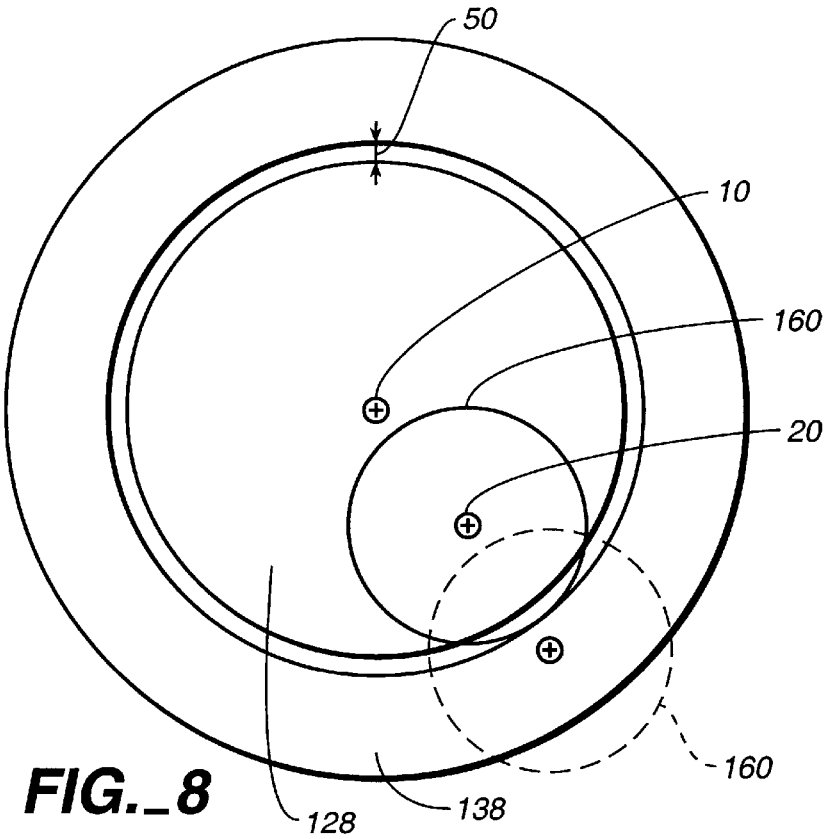

The carrier head 160 may oscillate laterally in any number of predetermined paths. The carrier head 160 may oscillate in such a way that the carrier head axis 20 oscillates only between two points on the first polishing surface 128, as shown in FIG. 6. Alternatively, the carrier head axis 20 may oscillate between two points on the second polishing surface 138, as shown in FIG. 7. Alternatively, the carrier head axis 20 may oscillate between a point on the first polishing surface 128 and a point on the second polishing surface 138 as shown in FIG. 8. The carrier head axis 20 may also oscillate in a figure-eight motion over the polishing surfaces.

Figure 9:
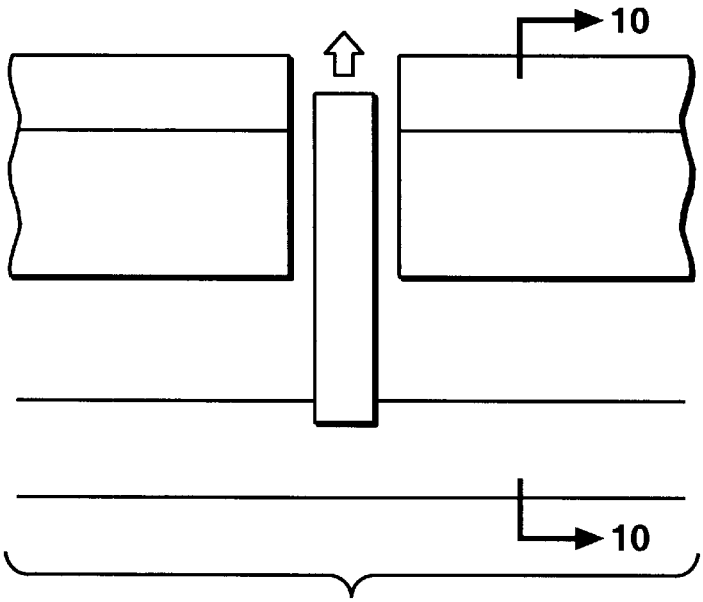
FIG. 9 is a close-up view of the right side of FIG. 4.

Referring to FIG. 9, a circular channel 70 may be provided below the boundary gap 50 to collect slurry and associated liquids expelled from the polishing surfaces. A suction force may be applied from below the boundary gap 50 to facilitate collection of liquids. The suction force may be generated by a pneumatic pump (not shown). The collected liquids may be drained from the circular channel 70 by a fluid passage (not shown).

Figure 10:
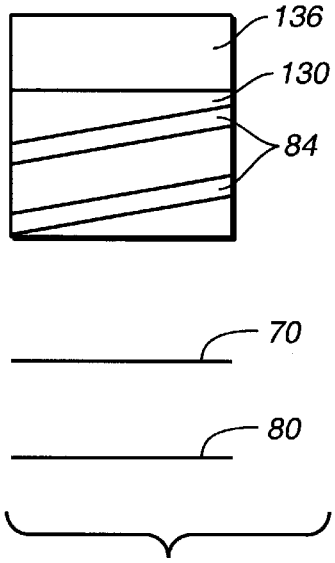
FIG. 10 is a cross-sectional view taken along line 10—10 of FIG. 9, showing a slurry reservoir and a spiral passage.

The polishing station may include a slurry delivery system to supply slurry to the polishing surfaces. As shown in FIGS. 9 and 10, the slurry delivery system includes a slurry reservoir 80 which may be located below the platens. The slurry in the slurry reservoir 80 may be delivered onto the polishing surface by at least one nozzle 82 placed in the boundary gap 50. As shown in FIG. 10, a spiral passage 84, extending down into the reservoir 80, may be provided in interior of at least one of the platens 120 and 130 to facilitate upward flow of slurry onto the polishing surfaces through the boundary gap 50.

The CMP apparatus grants a user greater control in polishing a substrate. The control perimeters that can be used include the size of the inner platen 120, the size of the outer platen 130, the rotational direction and speed of the inner platen 120, the rotational direction and speed of the outer platen 130, and the positioning of the carrier head 160. The inner and outer platens 120 and 130 may be rotated at the same speed and in the same direction to replicate polishing process of a conventional polishing station with one rotatable platen. The polishing rate under such a method is substantially uniform along radii of a substrate.

On the other hand, the inner and outer platens 120 and 130 may be rotated in opposite directions and at different rates. This technique may be used to create non-uniform polishing rates so that some areas of the substrate are polished at faster rate than other areas. In addition, rotating the inner and outer platens in opposite directions reduces the adhesive force between the substrate and the polishing pads since the inner platen and the outer platen are exerting opposing forces on the substrate. Consequently, substrates may be removed more easily from the polishing pads after the polishing process is completed.

FIGS. 11–15 are graphs displaying effects on polishing by varying the control perimeters. Each figure illustrates the relative speed of a point on the wafer as a function of the radius of the wafer. The polishing rate may be assumed to be directly proportional to the relative speed, i.e., relative motion between the polishing pad and the wafer. In each case, the relative speed is compared against a substrate polished with both platens rotating in the same direction and at the same speed.

Figure 11:
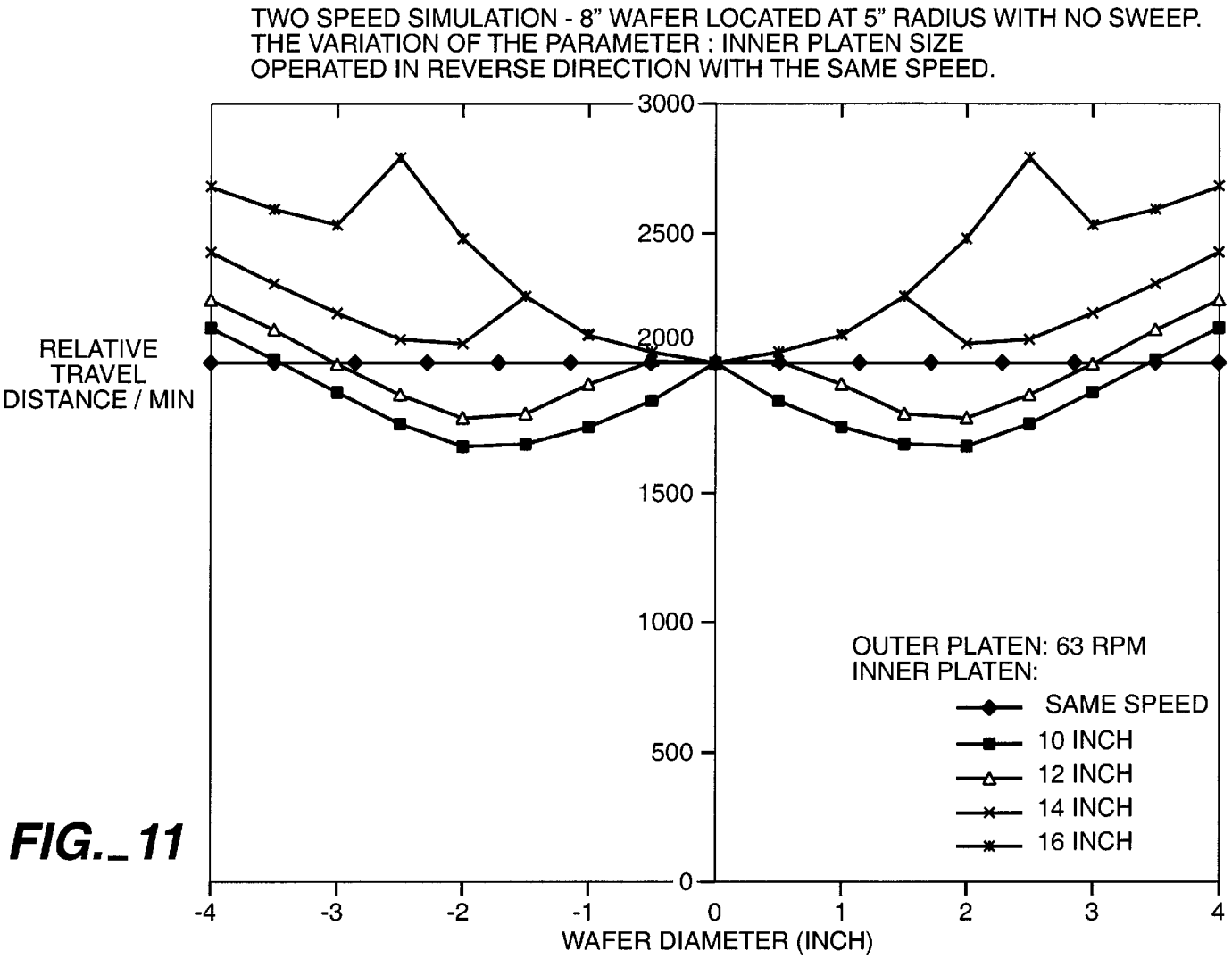
FIGS. 11–15 are graphs showing effects on polishing rate as control parameters are varied.

FIG. 11 shows the effects on the polishing rates of a wafer as the size of the inner platen 120 is varied. An eight inch wafer is placed on the polishing pads, where the wafer axis is five inches away from the main central axis 10. The inner platen 120 and outer platen 130 are rotated in the opposite directions at speed of about 63 rpm. The carrier head 160 is fixed in position above the polishing surfaces and does not oscillate laterally. The polishing speeds are calculated for inner platen diameters of 10 inches, 12 inches, 14 inches, and 16 inches with the outer platen diameter fixed at 22 inches. The results show that polishing rates differ according to radial distance from the wafer axis.

Figure 12:
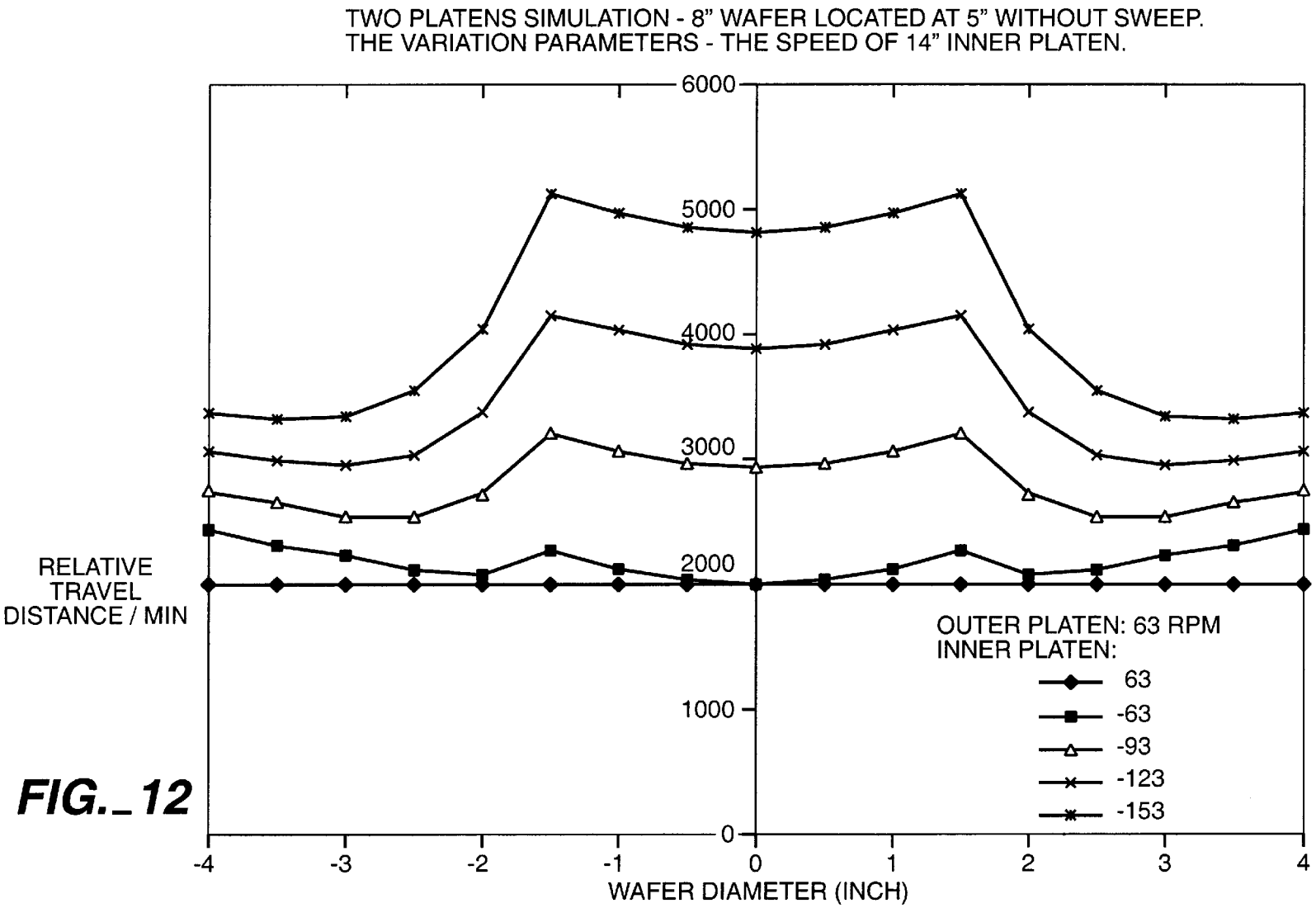

FIG. 12 shows the effect on the polishing rates as the rotational speed of the inner platen 120 is varied. An eight inch wafer is placed on the polishing surfaces where the wafer axis is five inches from the main central axis 10. The outer platen 130 has diameter of 22 inches and has a speed of about 63 rpm. The inner platen 120 has diameter of fourteen inches. The carrier head 160 is fixed in position above the polishing surface and does not oscillate laterally. The polishing rate is calculated for inner platen rotational speeds of approximately −63 rpm, −93 rpm, −123 rpm, and −153 rpm. The results show that polishing rates in the central area of the wafer has substantially higher polishing rates than the rest of the wafer.

Figure 13:
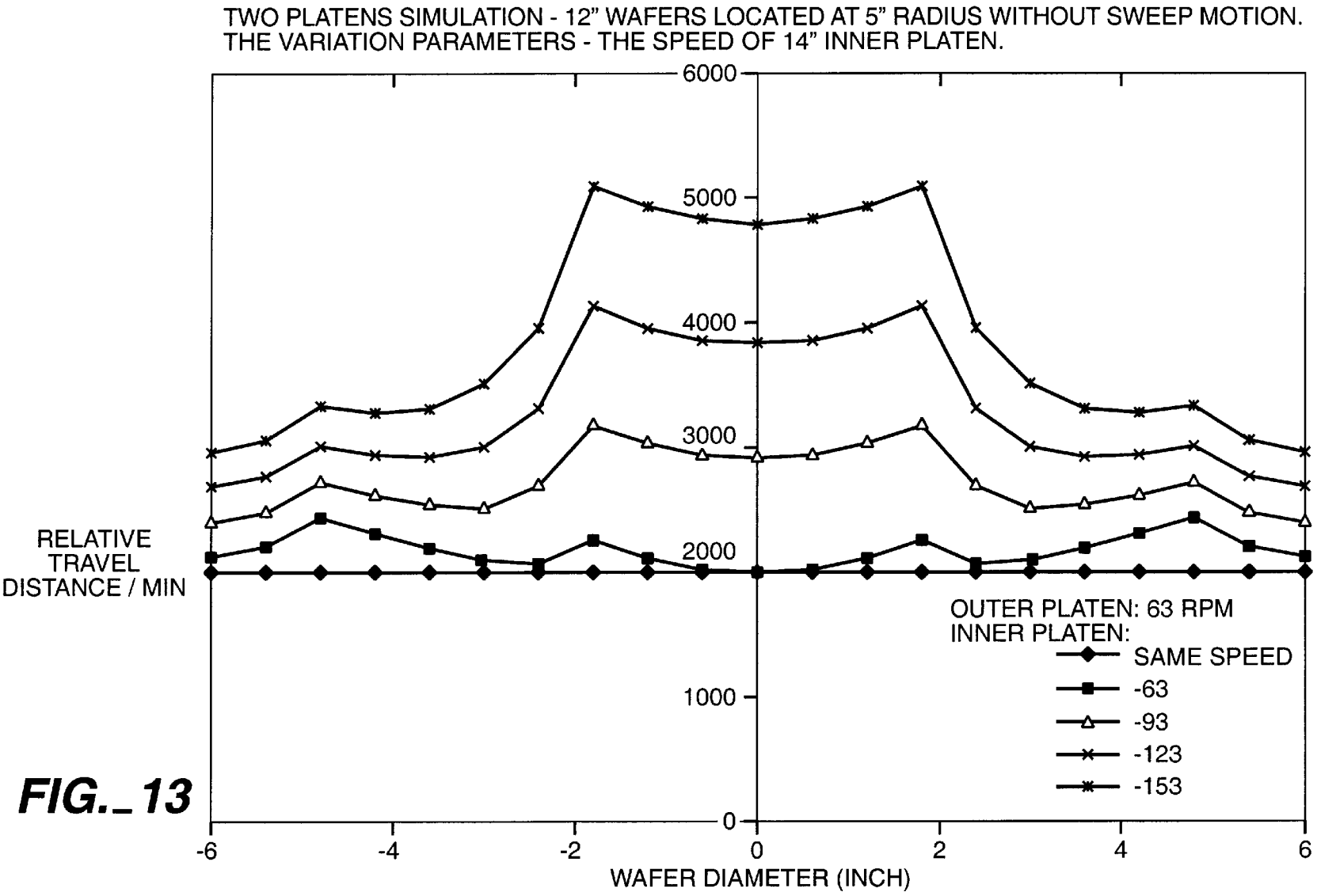

FIG. 13 also shows the effects on the polishing rates as the rotational speed of the inner platen 120 is varied. A twelve inch wafer, rather than an eight inch wafer, is placed on the polishing surfaces where the wafer axis is five inches from the main central axis 10. The outer platen has diameter of 22 inches and a speed of about 63 rpm. The inner platen 120 has diameter of fourteen inches. The carrier head 160 is fixed in position above the polishing surface and does not oscillate laterally. The polishing rate is measured for inner platen rotational speeds of approximately −63 rpm, −93 rpm, −123 rpm, and −153 rpm. The minus sign indicates that the inner platen is rotating in opposite direction to the outer platen. As in FIG. 12, the results show that polishing rates in the central area of the wafer has substantially higher polishing rates than the rest of the wafer.

Figure 14:
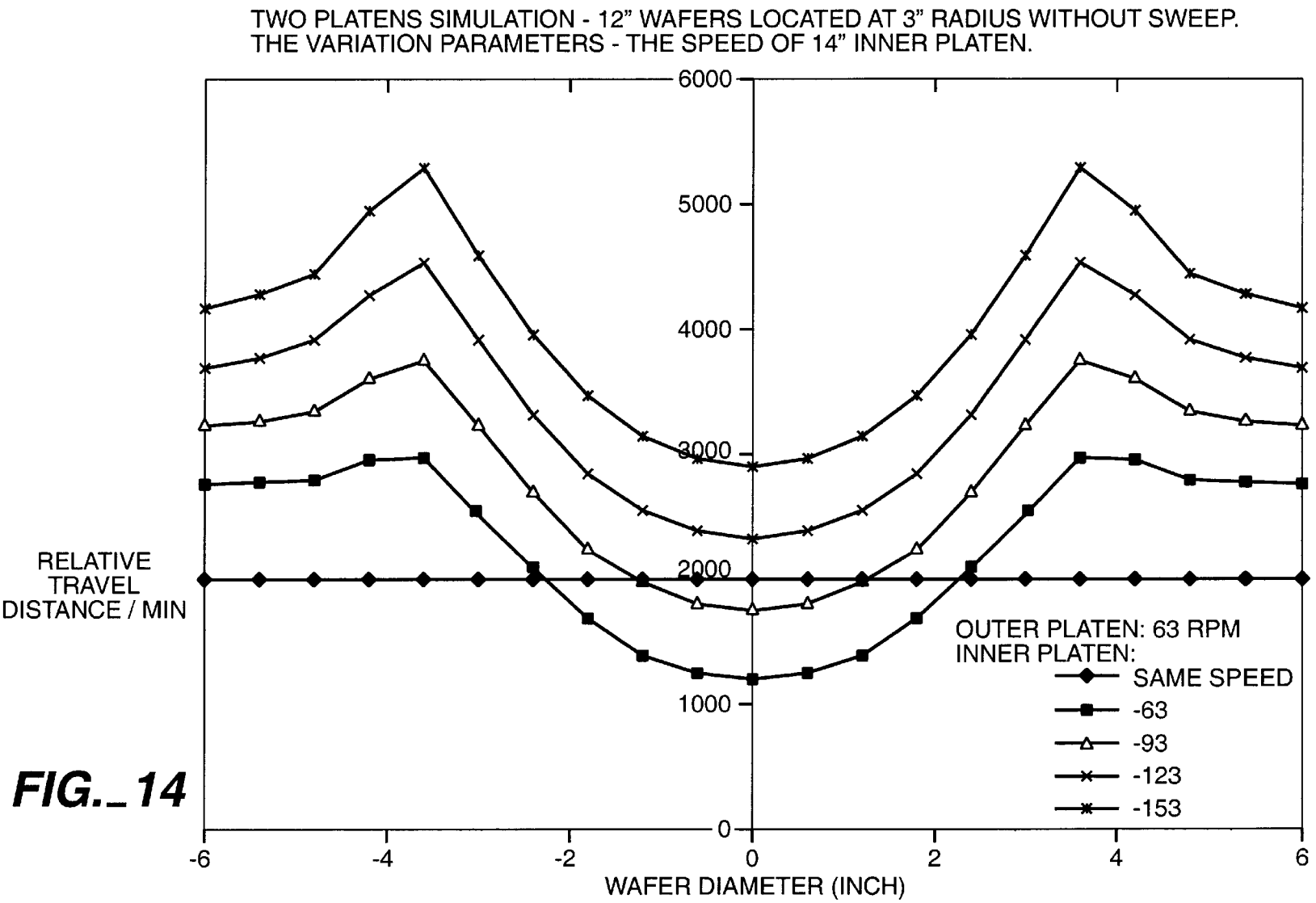

FIG. 14 shows the effects on the polishing rates as the distance between the wafer axis and the main central axis 10 is varied. A twelve inch wafer is placed on the polishing surfaces where its wafer axis is three inches, rather than five, from the main central axis 10. The outer platen has diameter of 22 inches and a speed of about 63 rpm. The inner platen 120 has diameter of fourteen inches. The carrier head 160 is fixed in position above the polishing surface and does not oscillate. The polishing rate is measured for inner platen rotational speeds of approximately −63 rpm, −93 rpm, −123 rpm, and −153 rpm. The results show that polishing rates decrease towards the center of the wafer.

Figure 15:
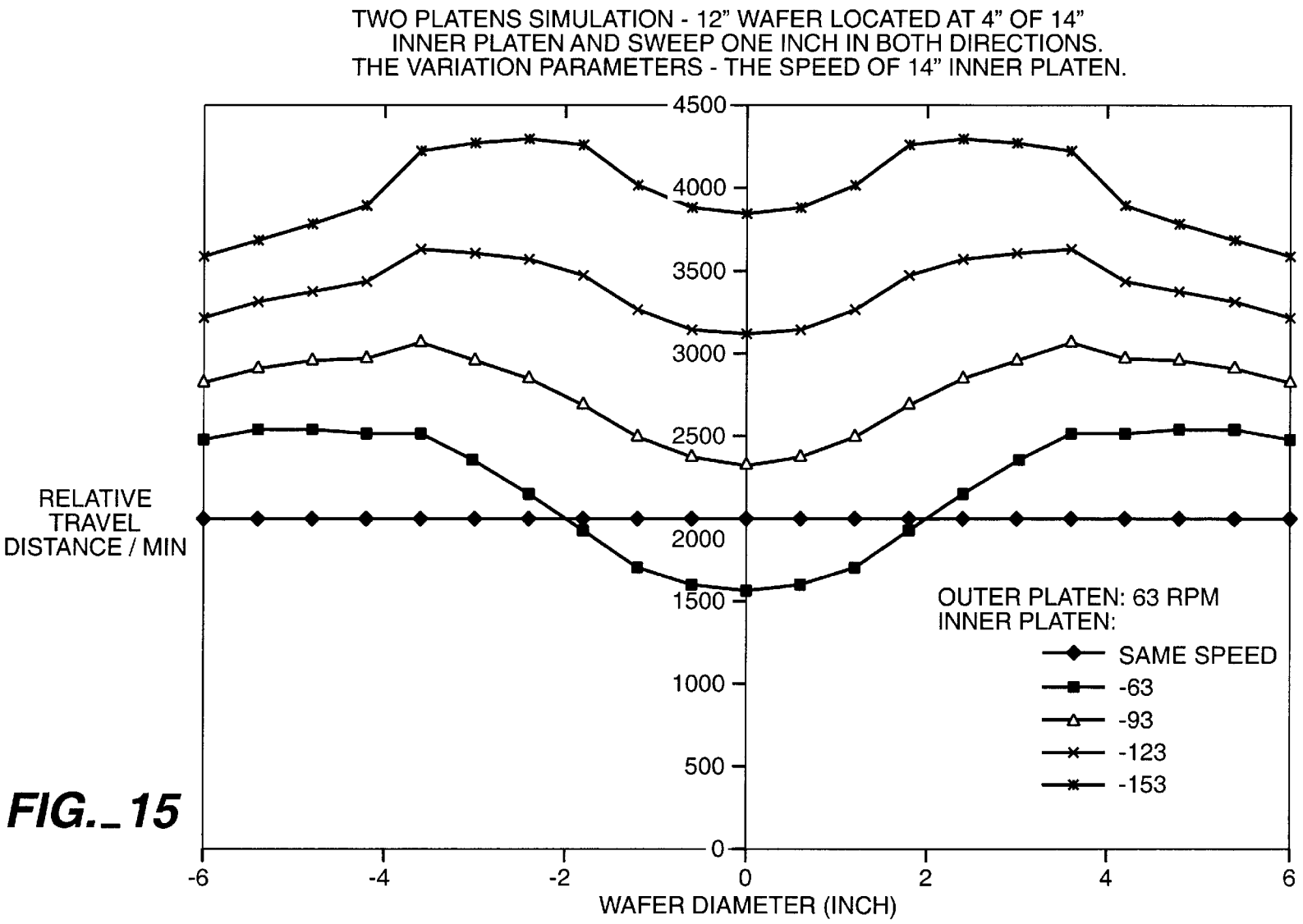

FIG. 15 shows the effect on the polishing rates as the carrier head 160 is oscillated between two points on the polishing surface. A twelve inch wafer is placed on the polishing surface where its axis is four inches from the main central axis 10. The wafer axis is aligned to the carrier axis 20. The outer platen has diameter of 22 inches and a speed of about 63 rpm. The inner platen 120 has diameter of fourteen inches. The carrier head 160 is linearly oscillated one inch towards the main central axis 10 and one inch in the opposite direction thereto from the initial point. The results show that areas within radius of 2 and four inches have higher polishing rates than other areas and polishing rates increase as the rotational speed of the inner platen is increased.

In another embodiment, the polishing station may have more than two rotatable platens. A CMP apparatus having a plurality of polishing stations may have a combination of one or more polishing stations with a single rotatable platen and one or more polishing stations with a plurality of rotatable platens. A substrate may be polished by polishing on a combination of a single-platen polishing station and a multiple-platen polishing station.

The present invention has been described in terms of a preferred embodiment. The invention, however, is not limited to the embodiment depicted and described. Rather, the scope of the invention is defined by the appended claims.

What is claimed is:

1. A method of polishing a substrate, comprising the steps of:

rotating a first platen having a first polishing surface about an axis;

rotating a second platen surrounding the first platen having a second polishing surface about the axis;

placing a face of the substrate in contact with at least one of the first and second polishing surfaces; and directing slurry from a reservoir through a nozzle located in a gap between the first and second platens onto at least one of the first and second polishing surfaces.

2. The method of polishing the substrate according to claim 1, wherein the first and second platens are rotated simultaneously.

3. The method of polishing the substrate according to claim 1, wherein the second platen is rotated before the first platen is rotated.

4. The method of polishing the substrate according to claim 1, wherein the first and second platens are rotated at different speeds.

5. The method of polishing the substrate according to claim 1, wherein the first and second platens are rotated in opposite directions.

6. The method of polishing the substrate according to claim 1, wherein the substrate is placed in sliding engagement with at least one of the polishing surfaces by a carrier head.

7. The method of polishing the substrate according to claim 6, wherein the carrier head rotates about a carrier head axis.

8. The method of polishing the substrate according to claim 7, wherein the carrier head oscillates laterally in a predetermined path over the first and second polishing surfaces.

9. A method of polishing a substrate, comprising:

rotating a first platen having a first polishing surface about an axis in a first direction;

rotating a second platen surrounding the first platen having a second polishing surface about the axis in a second direction opposite to the first direction;

bringing a face of a substrate into contact with the first and second polishing surfaces as the polishing surfaces rotate in opposite directions; and removing the substrate from the first and second polishing surfaces.

10. A chemical mechanical polishing apparatus, comprising:

a first platen rotatable about an axis, the first platen including a first top surface;

a second platen surrounding the first platen and rotatable about the axis, the second platen including a second top surface separated from the first top surface by a gap;

a reservoir to store a slurry; and a nozzle fluidly coupled to the reservoir and located in the gap to introduce slurry from the reservoir onto a polishing surface on at least one of the first and second top surfaces.

11. The chemical mechanical polishing apparatus of claim 10, wherein the first platen and the second platen are rotatable in opposite directions.

12. The chemical mechanical polishing apparatus of claim 10, wherein the first and second platens are independently rotatable in either a clockwise or counter-clockwise direction.

13. The chemical mechanical polishing apparatus of claim 10, further including:

a first polishing pad on the first top surface, the first pad providing a first polishing surface; and a second polishing pad on the second top surface, the second pad providing a second polishing surface.

14. The chemical mechanical polishing apparatus of claim 13, wherein the first polishing pad and the second polishing pad have different polishing properties.

15. The chemical mechanical polishing apparatus of claim 13, wherein a carrier head holds a substrate and places a face of the substrate in engagement with at least one of the first and second polishing surfaces.

16. The chemical mechanical polishing apparatus of claim 10, wherein the reservoir is located below the platens.

17. A chemical mechanical polishing apparatus, comprising:

a first platen rotatable about an axis;

a reservoir to store a slurry; and a spiral passage extending through the first platen and fluidly coupled to the reservoir to assist an upward flow of slurry from the reservoir onto a polishing surface on the first platen.

18. The apparatus of claim 17, further comprising a second platen rotatable about the axis.

* * * * *